United States Patent [19]

Weber

[11] 3,935,621

[45] Feb. 3, 1976

[54] STUFFER CRIMPING APPARATUS

[75] Inventor: Bernd Weber, Obernau, Germany

[73] Assignee: Akzona Incorporated, Asheville, N.C.

[22] Filed: Jan. 14, 1974

[21] Appl. No.: 432,838

[30] Foreign Application Priority Data

Jan. 18, 1975 Germany ..... 2302363

[52] U.S. Cl. ..... 28/1.6; 28/1.8

[51] Int. Cl.² ..... D02G 1/12; D02G 1/14

[58] Field of Search ..... 28/1.2, 1.3, 1.6, 1.8

[56] References Cited

UNITED STATES PATENTS

| | | | |
|---|---|---|---|
| 3,076,250 | 2/1963 | Baer | 28/1.6 |
| 3,256,134 | 6/1966 | Rice | 28/1.8 X |

FOREIGN PATENTS OR APPLICATIONS

| | | | |
|---|---|---|---|
| 653,475 | 12/1962 | Canada | 28/1.8 |
| 6,410,786 | 3/1965 | Netherlands | 28/1.8 |

*Primary Examiner*—Robert R. Mackey

*Attorney, Agent, or Firm*—Johnston, Keil, Thompson & Shurtleff

[57] ABSTRACT

A stuffer crimping apparatus in which an outer hollow wheel and an inner roller wheel are mounted on eccentrically positioned rotatable shafts with the outer rolling surface of the inner wheel being pressed toward the inner rolling surface of the outer hollow wheel to form an extended nip zone engaging the yarn. The two wheels also form between their rolling surfaces a yarn feed chamber at the entry to the nip zone and a crimping or stuffing chamber adjacent the exit of the nip zone. The apparatus is particularly useful for crimping synthetic thermoplastic yarns.

10 Claims, 16 Drawing Figures

STUFFER CRIMPING APPARATUS

In general, this invention is concerned with a stuffer crimping apparatus, commonly referred to as a "stuffer crimper" for the purpose of crimping or texturizing a synthetic thermoplastic filamentary tow or yarn and especially polyamide (nylon) or polyester (polyethylene terephthalate) yarns. Stuffer crimping is one of the more useful known methods of providing a texturized yarn by literally stuffing the yarn into an enclosed chamber, usually by means of feed rollers which nip the yarn between their outer circumferential rolling surfaces in order to rapidly feed the yarn into the chamber, compress the yarn in a random folded pattern within the chamber and gradually move the mass of yarn through the chamber by the force of the feed yarn entering the chamber at a high rate of speed. See, for example, the description on pages 80–83 of "Woven Stretch and Textured Fabrics" by B. L. Hathorne, Interscience Publishers, Division of John Wiley & Sons, N.Y. (1964). The apparatus used is sometimes called a stuffer box machine due to the fact that the feed rollers impel the yarn into a stationary crimping box or chamber, for example in the form of an elongated tubular member having a gate or similar partial closure member at its discharge end to maintain a certain pressure on the yarn passing through the crimping chamber. More or less elaborate mechanical means may be used to control this pressure, as disclosed for example in U.S. Pat. No. 2,734,229 or in U.S. Pat. No. 2,960,730.

In practice, only two different techniques have been used to feed the yarn into the stuffing chamber of the stuffer crimping apparatus. One possibility is to accomplish the yarn feed by means of an injector nozzle through which the yarn is impelled by an air jet or other gas jet, the force of the injection being sufficient to crimp, compress and move the yarn through the crimping chamber. It is preferable however to employ the mechanical feed means described above, i.e. a pair of feed rolls or godets operated at high speed.

While a mechanical feed for the yarn into the crimping chamber of a stuffer crimper is thus preferred, it is known that the yarn being crimped exhibits an irregular or erratic volume deposition which arises at least in part from the vibrations of the machine leading to variations in the nip pressure between the two feed rolls or godets and thereby causing an irregular yarn slippage. Prior stuffer box machines do not offer a satisfactory solution to this problem, and these machines also have the disadvantage of providing only limited crimping capabilities within a relatively narrow range of variable conditions. Regulation of these conditions is difficult and the random crimp characteristics of the final products are not easily controlled even though limited in scope.

It is the object of the present invention to provide a stuffer crimping apparatus which avoids these disadvantages and other problems of the prior stuffing box machines, a more particular or special object being to substantially eliminate or greatly reduce uncontrolled yarn slippage so as to provide a more uniform yarn feed during the crimping process. Other objects and advantages of the invention will become more apparent from the following description of the invention.

It has now been found, in accordance with the invention; that stuffer crimping of synthetic thermoplastic yarn can be carried out in a much more advantageous manner by means of apparatus comprising an outer rotatable hollow wheel having an inner circular rolling surface, an inner rotatable wheel having an outer rolling surface of smaller diameter than the inner diameter of the circular rolling surface of the outer wheel, the axis of rotation of the inner wheel being eccentric to the axis of rotation of the outer wheel and the rolling surfaces of the two wheels being pressed toward each other to form a nip zone for rolling engagement with the yarn fed therebetween, and means to rotate each wheel in the same direction and at the same peripheral speed of the rolling surfaces. The outer wheel is preferably a disc-type wheel, i.e. where the outer hollow wheel or rim has a flange plate on one side to close off two wedge-shaped gaps or a crescent-shaped area between the two rolling surfaces on either side of the nip zone where these rolling surfaces coincide or engage with the yarn being fed and extending around the remaining circumference of the inner wheel. This crescent-shaped area is functionally divided into a yarn feed chamber between the two rolling surfaces at the entry to the nip zone and a yarn crimping chamber between the two rolling surfaces at the exit from the nip zone. Thus, a yarn feed guide such as a tubular guide element is preferably arranged in the yarn feed chamber while a yarn deflector or discharge guide means is preferably arranged between the two rolling surfaces at the exit from the nip zone, preferably in a position about diametric to the nip zone. Finally, it is of value to include a gate means or flap-type closure means to extend across the crimping chamber in opposition to the movement of the yarn therethrough.

The yarn feed guide, the yarn deflector and the gate means are all preferably mounted on or fastened to a releasable cover plate which is mounted over the side of the hollow wheel opposite its flange plate, this cover plate essentially acting with the flange plate to enclose the feed and crimping chambers therebetween. This cover plate is preferably hinged or pivoted to swing away from the rotatable wheels in order to load the yarn or otherwise service the device. When closed, the cover plate remains in a fixed position in close abutment with the edges of the wheels on their open side opposite the outer wheel flange plate, preferably so as to enclose the nip zone as well as the yarn feed and crimping chambers.

Particularly good results have been achieved by using a ratio of the inner diameter of the outer wheel, i.e. its inner rolling surface, to the outer diameter of the inner wheel of approximately 1:0.85 to 1:0.98. It is also advantageous to employ conventional means to press the two wheels together in rolling engagement with the yarn fed therebetween, for example by using an adjustable bearing means for the rotatable drive shaft or driven shaft of one of the wheels, preferably the inner wheel. For convenience in mounting both wheels, it has been found advantageous to have the outer wheel mounted on a relatively large hollow shaft while the inner wheel is mounted on a smaller rotatable shaft which extends through the hollow shaft.

The rolling surfaces of the two wheels may be relatively smooth in servng only as a feed means into the crimping chamber. Also, these rolling surfaces are preferably cylindrical in shape with a continuous circular cross-section perpendicular to the axis of rotation. On the other hand, these rolling surfaces may also be profiled in the running direction of the yarn and/or transversely thereto. For example, a tooth-like or corrugated serration of the rolling surfaces, which may then interengage each other as with gears, is quite advantageous in forming or impressing a fine crimp on the yarn passing therebetween. Profiling of the surfaces is also possible to help retain the yarn within the crimping chamber or to vary the direction of the yarn feed.

The stuffer crimping apparatus of the invention may also be provided with other elements or variations beyond those described briefly above, including its combination with other conventional textile machinery, without departing from the spirit or scope of the invention. This is likewise true of the following detailed description and illustration of especially preferred embodiments of the invention, taken in conjunction with the accompanying partly schematic drawings in which.

The same or similar reference numerals are used throughout these drawings to identify the same or similar parts. Some variations in structure are merely described without being illustrated.

Figure 1:
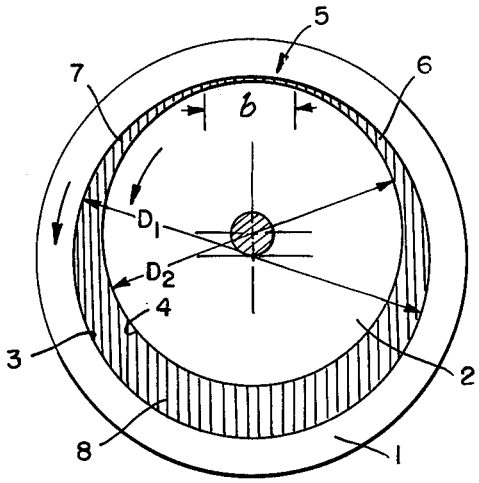
FIG. 1 is a front view of the arrangement of the outer hollow wheel and the inner roller wheel.
Figure 2:
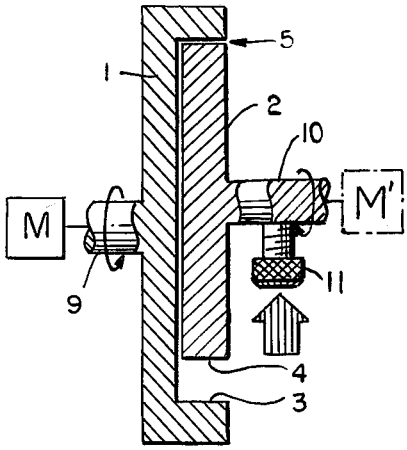
FIG. 2 is a longitudinal section of the two wheel arrangement of FIG. 1.

Referring first to FIGS. 1 and 2, there are shown the two essential and basic elements of the crimping apparatus of the invention, i.e. the outer hollow wheel 1 and the inner roller wheel 2 with inner rolling surface 3 and outer rolling surface 4, respectively. As will also be seen in FIG. 6, the outer wheel and inner wheel 2 form a nip zone 5 having the breadth *b*, i.e. where the yarn is effectively gripped or held without slippage during the crimping operation. This nip zone is formed by the eccentric position of the axis of rotation of the roller wheel 2 with respect to the axis of rotation of the hollow wheel 1. A crescent-shaped space or area 8 is defined by the two opposed rolling surfaces 3 and 4 outside of the nip zone 5. Just before the nip zone, i.e. on its entry side, there is a wedge-shaped gap 6 which provides a small yarn feed chamber into which the yarn can be easily directed by means of any suitable yarn guide such as element 6a shown in FIGS. 3, 5 and 6. On the discharge side of the nip zone 5, there is a similar wedge-shaped gap 7 which is preferably utilized as the yarn crimping chamber or stuffing chamber up to a widened out and more central portion of the crescent-shaped area 8.

The particular embodiment of FIGS. 1 and 2 indicates how the two wheels 1 and 2 can be supported for rotation on the shafts 9 and 10, respectively, extending from the rear and front of the device and mounted in a suitable framework or external housing. The outer wheel 1 is preferably driven by shaft 9 by means of a motor M with conventional means to adjust the speed of rotation. The inner wheel 2 can also be positively driven over shaft 10 by a motor M′ so as to be synchronized to rotate both rolling surfaces 3 and 4 at the same peripheral speed. However, it is preferable to positively drive only the outer wheel 1 with the inner wheel 2 being freely rotatably mounted on shaft 10 and being pressed upwardly so that its outer rolling surface 4 is pressed onto the inner rolling surface 3 of wheel 1 at the nip zone 5 with a force sufficiently great to transmit rotation from wheel 1 to wheel 2 but not so great as to cause damage to the yarn. This force for pressing together the two rolling surfaces in the nip zone is most advantageously accomplished by applying an adjustable pressure to the supporting or driven shaft 10 of the inner wheel 2 as indicated by the adjusting screw 11.

Other equivalent pressure adjusting means can also be used in order to provide the most appropriate pressure on the inner wheel 2 in a radial direction toward the center of the nip zone 5. Spring means can also be incorporated to provide a predetermined resilient pressure between the rolling surfaces, and such pressure can be applied over one or both wheels with only minor modifications in the embodiments illustrated herein.

Figure 3:
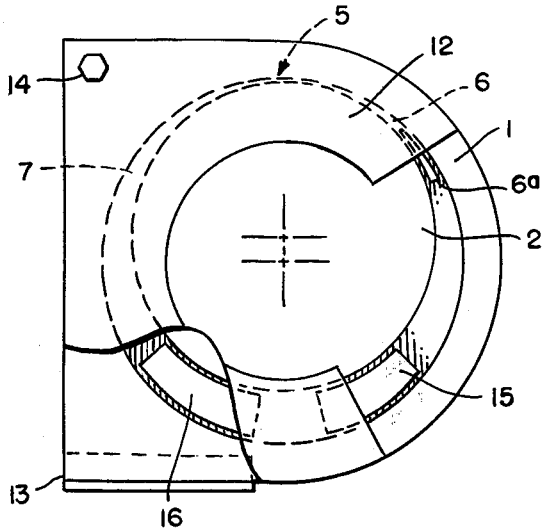
FIG. 3 is a front view of the same two wheels as in FIG. 1 but with a cover plate added and with the shafts of the wheels extending from the back, one shaft being hollow.
Figure 4:
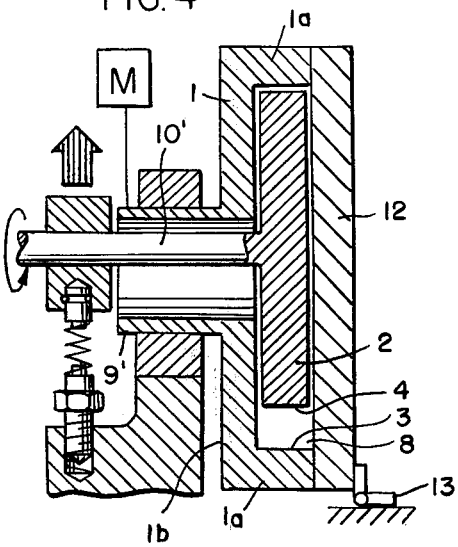
FIG. 4 is a longitudinal section of the two wheel embodiment of FIG. 3.

The same kind of adjustable nip pressure can be applied in the embodiment of FIGS. 3 and 4 which illustrate a preferred embodiment wherein the driven shaft 10′ of the inner wheel 2 extends backwardly through the larger hollow drive shaft 9′ of the outer wheel 1. Again, pressure is exerted in the direction of the vertical arrow.

As shown in FIGS. 3 and 4, a cover plate 12 is placed over the front of the two wheels where the front edge of the wheel rim 1a and the front face of wheel 2 can be arranged in a single plane capable of fitting with a very close tolerance in close proximity to the back face of the cover plate 12. It is also preferable to mount this cover plate 12 on a pivot, for example by means of a hinge 13 at its lower right corner as shown in FIG. 4. This permits the cover plate to be swung down from the wheels to permit easy access while it can be otherwise placed in a fixed and easily locked position, e.g. with a locking bolt 14 or the like into a backstand or other framework.

The cover plate may completely cover the front side of the device as schematically indicated by FIG. 4, but it is sufficient to provide the C-shaped plate 12 as indicated in FIG. 3, preferably with at least the left-hand side squared off for mounting on the hinge 13 and locking with bolt 14. It is desirable in all cases to cover the feed chamber 6, the nip zone 5 and the crimping chamber 7 so that these spaces or zones are fully enclosed by the cover plate 12 cooperating with the flange 1*b* of the outer hollow wheel 1 and the two rolling surfaces 3 and 4.

Figure 14:
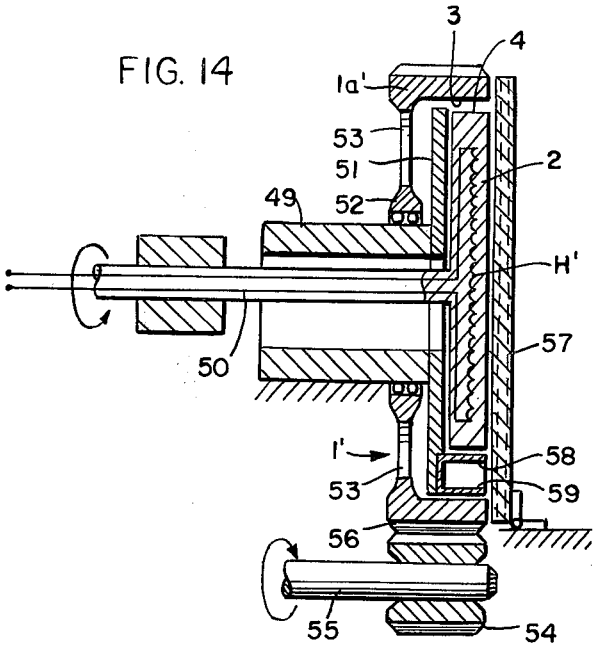
FIG. 14 is a cross-sectional and partly schematic illustration of another embodiment of the two wheel crimper with stationary front and back plates and a heated inner wheel.
Figure 15:
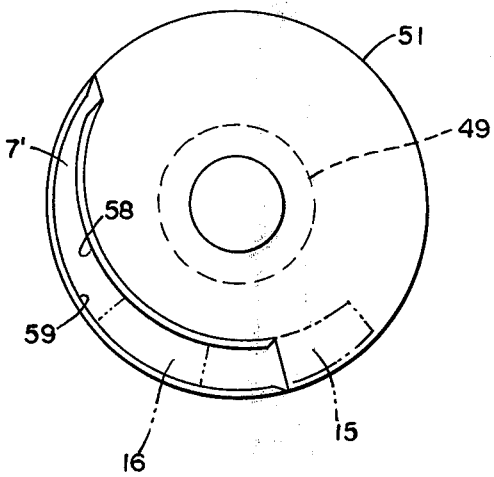
FIG. 15 is a front view of the stationary back plate used in the embodiment of FIG. 14 and carrying arcuate inserts which form a stationary crimping chamber.

In place of flange 1*b* of FIG. 4, it is also feasible as illustrated in FIGS. 14 and 15 to provide a stationary flange to cover the back face of the inner wheel 2, this stationary flange 51 being mounted on a fixed hollow shaft 49 similar to the shaft 9' of FIG. 4 through which the inner wheel shaft 50 can still be conducted. In this case, the outer wheel 1' can be supported rotatably on the fixed hollow shaft 49 behind the stationary inner flange 51 and can have a somewhat further extended rim such as 1'*a* which passes over both the inner flange 51 and the outer rolling surface 4 of the inner wheel 2. This rim 1'*a* may be connected to the hub 52 of wheel 1' by an unbroken disk or web flange or it may also be formed by radial spokes 53 in a plane just behind the stationary flange 51. The outer wheel 1' may be driven by gear 54 on drive shaft 55 engaging the peripheral gear 56 of the outer wheel. This embodiment provides an indication of how one can provide a stationary front wall 57 and back wall 51 for the open crescent shaped area (shown as 8 in FIG. 1) between the rolling surfaces 3 and 4. Moreover, such stationary front and/or back plates may also carry arcuate inserts or opposing chamber walls 58 and 59 extending in the axial direction and conformed closely to the rolling surfaces 3 and 4, particularly in the crimping chamber and extending backwardly from the gate 16 or preferably from deflector 15 (as shown in phantom in FIG. 15) to a point where the crimping chamber 7' is first filled with compressed yarn. In general, this filling point can be regulated by the rate of yarn draw off past the gate 16. It will be readily apparent that all fixed elements in the crescent-shaped area 8 between the rotating wheels may be separately mounted from a fixed frame or housing as well as being mounted on a cover plate or fixed inner flange.

Figure 5:
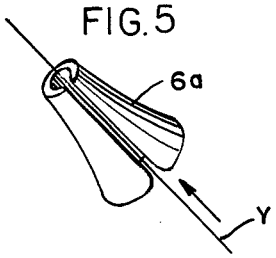
FIG. 5 illustrates in perspective a suitable yarn guide, especially for the yarn feed into the device.

Within the crescent-shaped space 8, there can be easily arranged the yarn feed guide 6*a* shown in an enlarged perspective view in FIG. 5, and also a thread discharge deflector or stripper 15 as well as a gate means 16, all shown as preferred embodiments in FIGS. 9–12 below. It will be noted that one arcuate segment of the cover plate 12 is omitted in order to provide a clear opening for the introduction and withdrawal of the yarn in its running path to and from the stuffer crimping machine. As shown in FIG. 5, the yarn Y is easily inserted through a longitudinal slot in the thread guide 6*a*, then carefully drawn through the nip zone 5 and brought around the open area 7 and 8 to the thread deflector 15. The cover 10 is then closed and preferably carries gate 16 into the area 8.

The stuffer crimper of the invention is preferably constructed of metal, especially where one or more parts are to be heated, e.g. by means of electrical resistance heaters. At least those surfaces in contact with the yarn being crimped should be relatively abrasion resistant, if necessary being coated with a hard, corrosion resistant surface layer. On the other hand, elements such as thread guides may be made of ceramic or a similar durable and abrasion resistant material. It is further feasible to provide a transparent plastic cover plate 12 in order to view the internal operation of the crimper. Similar windows can also be placed in a metal cover plate.

Figure 7:
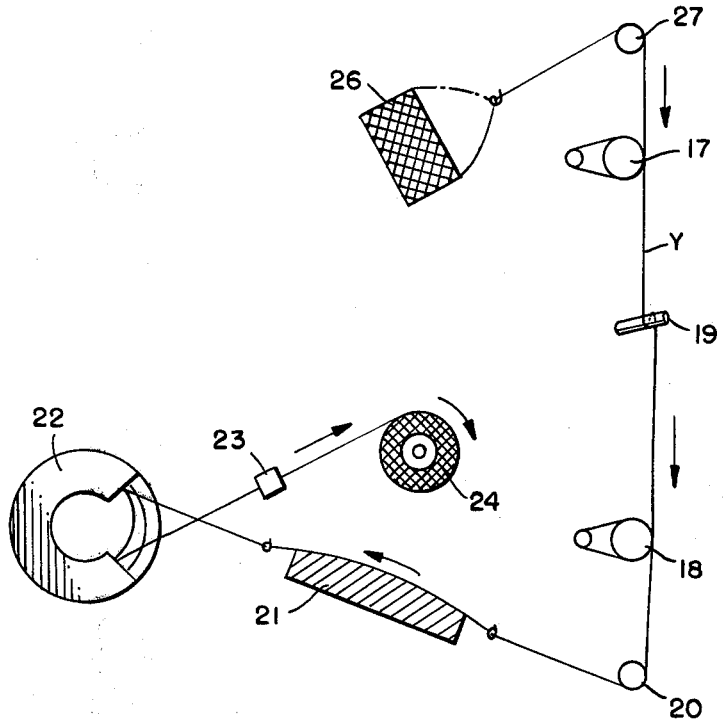
FIG. 7 is a schematic illustration of the yarn path in a draw-winding machine incorporating the stuffer crimping apparatus of the invention.
Figure 8:
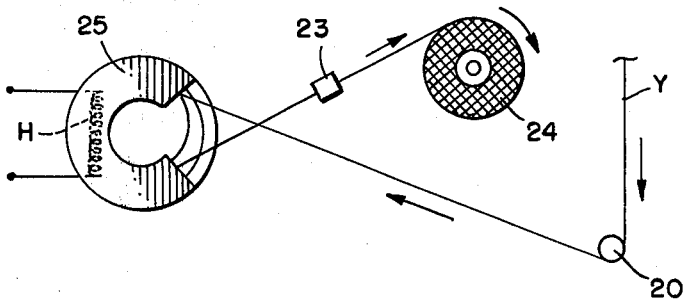
FIG. 8 is a schematic illustration of a further modification of the stuffer crimping apparatus to provide internal heating as compared to the preheating of the yarn as shown in FIG. 7.

As shown schematically in FIGS. 7 and 8, the texturizing effect of the stuffer crimper of the invention is advantageously combined with a draw-winding machine in order to both draw and crimp a previously undrawn yarn or thread. In FIG. 7, the yarn Y is stretched or drawn between the feed rolls 17 and draw rolls 18 in the form of conventional drawing godets, the yarn Y also being suitably conducted over a hot draw pin 19 or the like where required to achieve optimal drawing conditions. The yarn Y can then be conducted over guide roller 20 and the heating plate 21 directly into the stuffer crimper 22. After discharge from this crimper 22, the yarn is drawn off through the yarn brake 23 onto a winding or collection bobbin 24. The particular form and size of the heating device 21 depends upon the filamentary yarn material being treated, the yarn size and the winding or draw-off speed.

FIG. 8 illustrates a modified form of the draw-winding and texturizing apparatus of FIG. 7 wherein the heating device 21 has been replaced by an internal electrical resistance heating H of the stuffer crimper 25, preferably in the cover plate directly over the crimping chamber.

In this combination draw-winder and crimper (FIG. 7), the initially undrawn yarn may be taken from a supply bobbin 26 over the guide roller 27 into the drawing section 17, 18 and 19 or the yarn may be conducted directly from melt-spinning apparatus in which the synthetic filaments are first formed.

An especially preferred embodiment of the stuffer crimper according to the invention is that of FIGS. 9–13 wherein the cover plate 12' is locked over the interfitting wheels 1 and 2 by means of bolts 28 and 29 to form the crescent-shaped enclosure 8 up to the nip point 5. The yarn feed guide 30, the yarn deflector 31 and the spring flap gate 32 for the crimping chamber are arranged at appropriate positions of the enclosed space 8. The cover may be hinged as described above or simply pivoted on a lock bolt 28 after being pulled forward from the wheels 1 and 2. This cover plate 12' is constructed with two opposite arcuate corners and two opposite squared corners so as to completely overlap the outer wheel 1 except at the right-hand side where a small wedge section 33 is cut away along approximate radial lines of the inner wheel 2. A center circular portion 34 of the cover 12' is also cut away but with its edges overlapping the inner wheel 1 except at the open wedge section 33. Finally, an arcuate slot 35 is cut away from the cover plate 12' directly above that portion of the enclosure 8 which is adapted to receive the yarn deflector 31.

Figure 6:
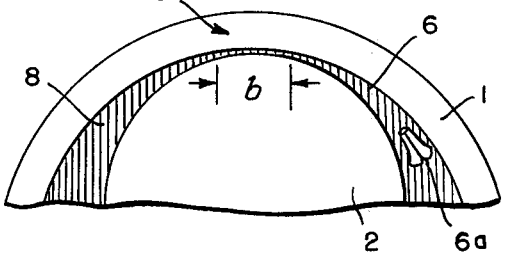
FIG. 6 is an enlarged partial view of the two wheels to indicate the approximate extent of the nip zone in terms of relative size.
Figure 9:
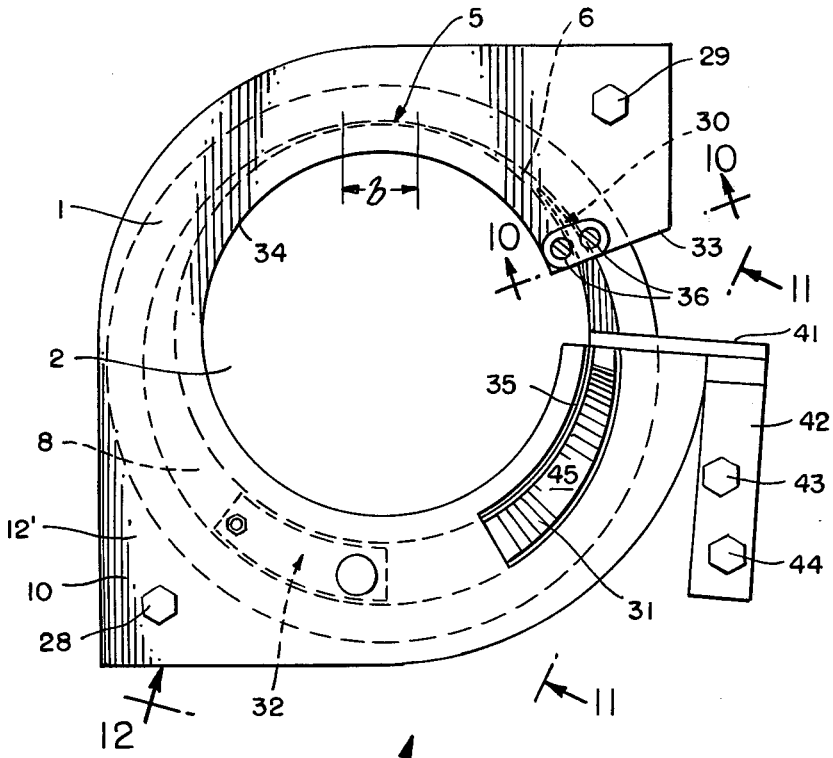
FIG. 9 is a more detailed front view of the stuffer crimping apparatus of the invention with its various elements in assembled position.
Figure 10:
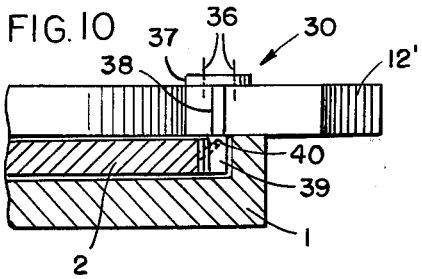
FIG. 10 is a partial view taken on line 10—10 of FIG. 9 to illustrate another embodiment of a yarn feed guide.

The yarn feed guide 30, which corresponds substantially with guide 6a of FIGS. 3, 5 and 6, is disclosed in greater detail in FIG. 10 taken with FIG. 9 where it is fastened directly to the cover plate 12′ at the leading edge of the open wedge section 33, for example by means of the pair of fastening screws or bolts 36 through mounting head 37. The stem member 38 passes through the plate 12′ in a corresponding slot thereof in order to firmly hold the guide block 39 which is curved to fit the enclosure or passage 8 between the rolling surfaces of wheels 1 and 2. The guide channel 40 also curves downwardly through this guide block 39 as shown in FIG. 10 so that the yarn can enter at an angle to the cover plate 12′ and wheels 1 and 2 and then be directed from the forward tip of the guide block 39 into the yarn feed chamber 6 so as to be smoothly received by the wheels at the nip point 5.

Figure 11:
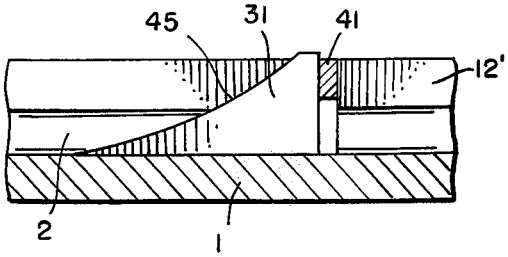
FIG. 11 is a partial view taken on line 11—11 of FIG. 9 to illustrate a specific embodiment of a yarn deflector.

In FIG. 11 taken with FIG. 9, the yarn deflector 31 is mounted separately from the cover plate on arm 41 extending over to a mounting bar 42 which can be fastened to a backplate or frame of the apparatus by bolts 43 and 44. The curved surface 45 directs the yarn upwardly and outwardly from the stuffer crimper through the arcuate slot 35 of cover plate 12′. This surface 45 is preferably doubly curved in order to more carefully channel or direct the crimped yarn from the stuffer crimper to a take-up or winding means. It is also feasible to mount this yarn deflector or stripper on the cover plate 12′ as shown in FIGS. 9 and 10 or to substitute an injector nozzle J in its place to suction off the crimped yarn.

Figure 16:
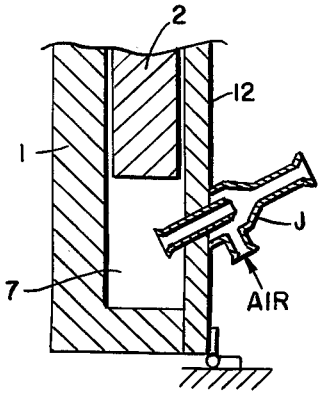
FIG. 16 is an enlarged cross-sectional and partly schematic view at the yarn withdrawal point of the crimper to show the use of an injector nozzle for removing the yarn.

This injector J as shown in FIG. 16 may also be convenientaly mounted on cover 12 at the lower discharge portion of the yarn crimping chamber, e.g. between the position of the omitted deflector 15 and the preceding gate 16 as shown in FIGS. 3 and 15.

Figure 12:
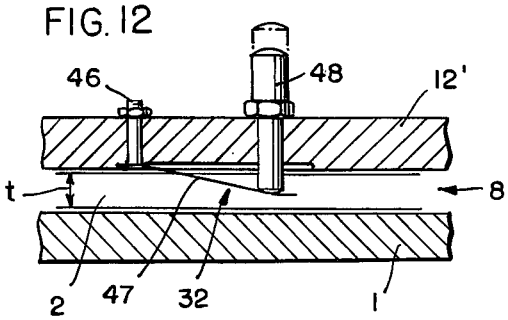
FIG. 12 is a partial view taken on line 12—12 of FIG. 9 to illustrate an adjustable gate means at the end of the crimping

In FIG. 12 taken with FIG. 9, there is illustrated an especially useful gate or closure means 32 fastened to the cover plate 12′ by means of the mounting pin and nut assembly 46 carrying the spring leaf member 47 to angle downwardly from its attached pin into the space 8 partly closed off in this manner at a point which is just about diametrically opposite the nip point 5. An adjusting screw or bolt 48 acts against the free end of the spring leaf 47 to regulate the amount of pressure being built up in the crimping chamber 8 preceding this gate or closure means 32. Other equivalent gates may also be provided and the position of this gate may also be varied depending upon the needed size or volume of yarn to be compressed in the crimping chamber.

Figure 13:
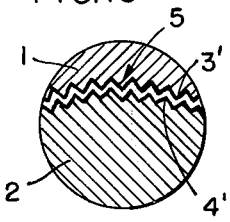
FIG. 13 is a highly enlarged view as a cross-section taken perpendicularly to the axis of rotation of the two wheels through their profiled rolling surfaces in the nip zone to illustrate interengaging teeth-like projections of the profiled surfaces.

In order to provide a fine crimping of the yarn together with an overlapping or relatively larger crimping superimposed by the stuffer crimping technique, the two rollers 1 and 2 may contain interengaaged profiled rolling surfaces 3′ and 4′ as indicated in the enlarged view of FIG. 13 where these surfaces are in the form of pointed teeth which intermesh at the nip point 5. By passing a heated yarn through such a nip point, the teeth impart a fine crimp, i.e. a relatively large number of crimps per unit length as compared to the crimping effect in the crimping of stuffing chamber. A preheating of the yarn is preferred as illustrated by the heating plate 21 in FIG. 7, although the profiled rolling surfaces themselves may be heated as indicated by heater H of FIG. 8 and/or by heater H′ of FIG. 14. It is also an advantage of the crimping device of the invention that it may be used to impart this saw-tooth or gear-type crimping alone without any substantial stuffer crimping. Moreover, this can be done without any substantial modification of the apparatus. Where both types of crimping are combined, it is preferable to insert a smooth surfaced liner in the crimping or stuffing chamber along the profiled rolling surfaces.

Referring to FIG. 1, one specific construction of the two wheel stuffer crimper of the invention can be given together with a set of operating conditions in using the combined draw-winding machine of FIG. 7. The effective nip zone has been designated as b throughout this specification, and $D_1$ may be used for the inner diameter of hollow wheel 1 while $D_2$ is the outer diameter of the inner roller wheel 2. The depth t of the crimping chamber 8 (see FIG. 12) is constant while its width varies in accordance with the difference between $D_1$ and $D_2$. With the unheated stuffer crimping device and with the two wheels pressed together at the nip point 5 (nip gap = 0 mm., using a resilient spring pressure on the inner wheel shaft to avoid damage to the yarn), the following conditions were also used:

| | |
|---|---|
| Inside diameter of hollow wheel $D_1$ | = 80 mm. |
| Outside diameter of roller wheel $D_2$ | = 70 mm. |
| Depth of stuffing chamber t | = 7 mm. |
| Rotational speed of inner roller wheel | = 4600 r.p.m. |
| Running speed of yarn | ≈ 1000 m/min. |
| Temperature of heating plate 21 | = 200°C. |

A polyethylene yarn of 48 individual filaments and a total yarn size of 150 dtex was crimped under these conditions to yield a very uniform texturized product of excellent quality.

The following discussion will provide a better understanding of the significance of the nip zone b with respect to the crimping device of the present invention.

From the book by Raymond J. Roark, "Formulas for Stress and Strain," McGraw-Hill Book Co., 4th Edition, Chapter 13, Table XIV (types 5 and 6), it is known that the following formulae can be used to calculate the extent or effective breadth $b$ of the nip zone between two circular cylinders with the diameters $D_1$ and $D_2$, respectively, pressing against each other with the force $P$, for that case on which both bodies have the same Poisson ratio and the same modulus of elasticity $E$:

I. Solid cylinder against solid cylinder:

$$b_I = \text{Constant} \cdot \sqrt{\frac{P}{E} \cdot \frac{D_1 \cdot D_2}{D_1 + D_2}}$$

II. Solid cylinder within hollow cylinder (or trough):

$$b_{II} = \text{Constant} \cdot \sqrt{\frac{P}{E} \cdot \frac{D_1 \cdot D_2}{D_1 - D_2}}$$

It is apparent from formula (I), which represents the usual arrangement of side by side feed rollers or godets, that the breadth $b$ of the nip zone can only be enlarged as a practical matter by increasing the roller diameters $D_1$ and $D_2$. The pressure P cannot be arbitrarily increased because of mechanical damage to the filamentary material being transported. From formula (II) on the other hand, it will be seen that the breadth $b$ of the nip zone, in comparison to the first cited formula, increases by a disproportionately greater extent with an increase in $D_2$ as compared to $D_1$. In other words, by maintaining a ratio of $D_1$:$D_2$ as low as possible, the breadth of the nip zone $b$ can be extended much further with the use of a hollow wheel and inner roller as compared to side by side rollers where both $D_1$ and $D_2$ must be increased to an impractical amount to achieve the same extension of the nip zone *b*.

These considerations are important in the present invention because it has been found that yarn slippage can only be effectively prevented by extending the breadth b of the nip zone through the use of an outer hollow wheel and an inner roller wheel. Moreover, this construction generally permits a lower pressure P so as to moderate not only the force at which the two wheels are pressed together but also the amount of force applied to the yarn at the nip point itself where damage to the yarn is most likely to occur. The volume of yarn deposited in the crimping chamber per unit of time is much more uniform and more accurately controlled. Thus, even with smooth rolling surfaces of the two wheels, there is a uniform yarn feed and a more uniform deposition of yarn with a more equalized pressure in the crimping chamber.

The stuffer crimping apparatus of the invention is also very advantageous in that it requires only a small amount of space, particularly due to the fact that the crimping chamber formed by the wheels themselves dispenses with the need for an elongated stationary tube as this crimping or stuffing chamber. This space reduction also means that the stuffer crimper of the invention can be readily combined with existing textile machines and can be fully integrated with other processes.

By way of example, the foregoing specification provides a description of the combination of a drawing or stretching process with a stuffer crimping operation using the two wheel crimping apparatus of the invention. Linear yarn speeds of up to 2,000 m/min. or more can be mastered without difficulties by use of the crimping apparatus of the invention.

Other advantages are also achieved with the stuffer crimper of the invention. Thus, in addition to a slip free feed of the yarn through the relatively broad nip zone, the moderate or more gentle nip pressure on the yarn results in a higher yarn strength. The better regulated crimping imparted by this device also leads to a more uniform volume deposition and throughput of yarn.

Finally, it should be noted that the apparatus of the invention lends itself to a much wider set of operating conditions. For example, stuffer crimping and/or gear crimping can be carried out with this apparatus, and the rotational speed of the two wheels may also be varied over a wide range to permit treatment of more easily damaged yarns at lower speeds. Compression in the crimping chamber is not entirely dependent upon the speed of ejection of the yarn from the nip zone but is also influenced by the rolling surfaces entering into and/or passing through the crimping chamber. The wheels or rollers of the stuffer crimper of the invention do not merely save space by their simultaneous formation of a crimping chamber but they also tend to forward the yarn through the chamber against the pressure of a gate or closure means at the discharge point of the chamber. This hollow wheel and inner roller crimping device is therefore extremely versatile with only minor changes in its individual parts and structure.

The stuffer crimper of the invention may be used with a wide variety of filamentary materials but is primarily intended for use with all types of synthetic thermoplastic filaments in the form of yarns, tows, threads and the like. Particularly good results have been achieved with polyester and polyamide yarns with a yarn size of about 80 to 2500 dtex. One can thereby achieve a wide variety of texturized yarns, including those that are durably crimped through being heat-set. High quality yarns are more easily obtained with a wide range of texturizing or bulking effects while maintaining tensile strength and other desirable textile properties.

The invention is hereby claimed as follows:

1. A stuffer crimping apparatus for crimping a synthetic thermoplastic yarn, said apparatus comprising:

an outer rotatable hollow wheel having an inner circular rolling surface:

an inner rotatable wheel having an outer rolling surface of smaller diameter than the inner diameter of the circular rolling surface of said outer wheel, the axis of rotation of said inner wheel being eccentric to the axis of rotation of said outer wheel, means to press the rolling surfaces of the two wheels toward each other to form a nip zone for rolling engagement with said yarn fed therebetween;

means to rotate each wheel in the same direction and at the same peripheral speed of said rolling surfaces;

flange means on one side of said outer hollow wheel forming a yarn feed chamber between the two rolling surfaces at the entry to said nip zone and also forming a yarn crimping chamber between the two rolling surfaces at the exit from said nip zone;

means to introduce the yarn into said feed chamber;

means to withdraw the yarn from said crimping chamber;

gate means to oppose the movement of yarn through said crimping chamber;

means enclosng said nip zone and crimping chamber; and means to heat the yarn for stuffer crimping.

2. Apparatus as claimed in claim 1 wherein said means to introduce the yarn comprises a yarn guide arranged in said yarn feed chamber and a yarn deflector arranged at the end of the yarn crimping chamber.

3. Apparatus as claimed in claim 2 wherein said means enclosing said nip zone and crimping chamber comprises a releasable cover plate mounted over the other side of said outer hollow wheel opposite said flange means; said cover plate at least partially enclosing said feed chamber.

4. Apparatus as claimed in claim 3 wherein at least one of said wheels and said cover plate is provided with said heating means.

5. Apparatus as claimed in claim 3 including means adjustably fastening said gate means to said cover plate to extend across said crimping chamber in opposition to the movement of yarn therethrough.

6. Apparatus as claimed in claim 1 wherein the ratio of the inner diameter of the outer hollow wheel to the outer diameter of the inner wheel is about 1:0.85 to 1:0.98.

7. Apparatus as claimed in claim 1 wherein said means to press the rolling surfaces of the two wheels toward each other comprises pressure adjustment means to provide a predetermined pressure between the rolling surfaces of the two wheels as they are urged toward each other in rolling engagement with said yarn fed therebetween.

8. Apparatus as claimed in claim 7 wherein the outer hollow wheel is mounted on a rotatable shaft having a fixed axis of rotation while said inner wheel is mounted on a rotatable shaft having an axis of rotation movable in a direction toward and away from said nip zone, said pressure adjustment means acting on said movable shaft of said inner wheel for pressing the two wheels together.

9. Apparatus as claimed in claim 1 wherein the outer hollow wheel is mounted on a hollow rotatable shaft and the inner wheel is mounted on a second rotatable shaft which extends through said hollow shaft.

10. Apparatus as claimed in claim 1 wherein each of said rolling surfaces contains interengaging profiles adapted to impress a fine crimp in said yarn fed therebetween.

* * * * *

UNITED STATES PATENT AND TRADEMARK OFFICE

CERTIFICATE OF CORRECTION

PATENT NO. : 3,935,621

DATED : February 3, 1976

INVENTOR(S) : WEBER

It is certified that error appears in the above-identified patent and that said Letters Patent are hereby corrected as shown below:

In the Heading, under "Foreign Application Priority Data" delete "Jan. 18, 1975" and substitute --Jan. 18, 1973--

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*